United States Patent [19]

Pottorff

[11] Patent Number: 4,852,442

[45] **Date of Patent: * Aug. 1, 1989**

[54] SELF-SHARPENING PERFORATOR FOR PLASTIC FILM

[76] Inventor: Earl T. Pottorff, 2346 Taylor Rd., Savannah, N.Y. 13146

[ * ] Notice: The portion of the term of this patent subsequent to Mar. 31, 2004 has been disclaimed.

[21] Appl. No.: 175,189

[22] Filed: Mar. 30, 1988

[51] Int. Cl.[4] ..... B26D 7/12; B26F 1/18; B26F 1/14

[52] U.S. Cl. ..... 83/697; 83/695; 83/837; 83/846; 83/751; 83/620

[58] Field of Search ..... 83/30, 620, 624, 751, 83/837, 846, 848, 697, 695, 694, 636, 691, 660; 493/372, 468, 204; 225/48, 49

[56] References Cited

U.S. PATENT DOCUMENTS

| | | | |
|---|---|---|---|
| 545,711 | 9/1895 | Miller | 83/695 |
| 604,150 | 5/1898 | Hoberg, Sr. | 83/697 |
| 3,147,658 | 11/1961 | Boyd | 83/660 |
| 4,506,816 | 3/1985 | Roccaforte | 225/48 |
| 4,653,372 | 3/1987 | Pottorff | 83/689 |
| 4,723,466 | 2/1988 | Pottorff | 83/684 |
| 4,732,068 | 3/1988 | Yasuda et al. | 83/695 |

FOREIGN PATENT DOCUMENTS

| | | | |
|---|---|---|---|
| 488532 | 5/1970 | Switzerland | 83/697 |

OTHER PUBLICATIONS

Jackson et al., Acetal Homopolymer, Modern Plastics Encyclopedia, pp. 8–9, 1985.

*Primary Examiner*—Donald R. Schran
*Assistant Examiner*—Yu Chi Lin
*Attorney, Agent, or Firm*—Wall and Roehrig

[57] ABSTRACT

A self-sharpening perforating punch head for perforating a web of plastic film is formed of one or more plates of a semirigid plastic resin, e.g. acetal homopolymer. The head has a row of tapered and beveled teeth which form a cutting edge at the back plane of the head. The cutting edge renews itself as the material wears by plastic-on-plastic abrasion. There are gaps provided at intervals among the teeth.

7 Claims, 2 Drawing Sheets

SELF-SHARPENING PERFORATOR FOR PLASTIC FILM

BACKGROUND OF THE INVENTION

This invention relates in general to punching or perforating apparatus and is more particularly directed to apparatus for perforating plastic film. The invention is directed also to a resiliently flexible self-sharpening punch head for such apparatus.

As is known to those skilled in the art, flexible plastic film or plastic bags formed from materials such as polyethylene, are frequently used in groceries and supermarkets to package bulk food items such as fruit, vegetables, grain, candies, etc. These bags are typically rolled on a spindle, and the user unrolls one bag as needed. The plastic film bag is torn at a row of perforation that separates each bag from the next, and a quantity of bulk food or an article such as a loaf of bread, is placed in the bag.

U.S. Pat. Nos. 3,654,829; 4,160,396 and 4,308,774 each disclose apparatus for perforating thermoplastic material utilizing a serrated knife edge to cut or punch holes in a plastic film. Such cutters have been formed from metal and require frequent periodic sharpening so that they will be keen enough to cut through the plastic. During the cutting operation, the plastic material is supported upon a backing plate having an opening formed therein which is larger than the cutting tool. The backing plate so formed enables the cutting tool to move through the plastic material while the material is held in position against the plate.

The metal cutting tools as used in the prior art are satisfactory only so long as the cutting tool or head remains sharp, and the tool and opening in the backing plate are maintained substantially in registry out of contact during the high speed punching operation. The hole in the backing plate must be relatively close to the same size as the punching die or cutting tool to prevent stretching of the plastic material. If proper alignment is not maintained, the teeth of the cutter will be broken, requiring replacement of the entire cutting head. In addition, the cutting of the thermoplastic material rapidly wears the metal cutting surfaces thus dulling the cutting tool and requiring frequent regrinding or resharpening of the cutting edge. The wear soon becomes excessive and the tool must be replaced.

A circular cutting head of a plastic resin material has been proposed by the inventor hereof, and this is described in his U.S. Pat. No. 4,653,372 of Mar. 31, 1987. That cutting head is formed of a semirigid material such as Delrin (acetal homopolymer). The head there is intended for punching circular holes in plastic material. That cutting head is sufficiently flexible so that the teeth deflect and bend, rather than break off, when the teeth strike the backing plate. The teeth are also self-sharpening as the head wears, so regrinding is unnecessary over the life of the cutting head.

OBJECTS AND SUMMARY OF THE INVENTION

It is therefore an object of this invention to improve apparatus for perforating films of plastic resin material.

It is a further object of this invention to maintain the sharpness of a cutting edge utilized to perforate the plastic film material.

Still another object of this invention is to reduce the weight of the cutting apparatus to minimize the inertial forces created during the high speed punching operation, thereby reducing wear and eliminating the necessity of complex control systems.

In accordance with the present invention, a mechanically operated punching apparatus produces a series of slits or holes in a flexible film or plastic bag. The disclosed embodiment utilizes one or more pneumatic air cylinders which reciprocate a fitting or attachment device that carries the cutting or perforating head. The interchangeable head has a row of teeth which are beveled to a pointed end. There are gaps of a desired width at intervals, e.g., after every other tooth, with the size and spacing of the gaps depending on the type and thickness of the plastic film material, and the desired end use by the customer, so that the cutting head achieves a predetermined percentage of material remaining along the perforation line. In a backing die or backing plate there is an elongated aperture or passage into which the perforating head penetrates. The head is formed of a semirigid plastic resin material. The teeth are self-sharpening when employed to cut perforations in the plastic film material. The semirigid resin material is sufficiently resilient such that if the perforating head contacts the backing die during a punching or perforating operation, the cutting teeth will resiliently deflect rather than break off so that the perforating operation can continue.

The perforating heads can be formed in two or more sections or formed as a single plate.

The above and other objects, features, and advantages of this invention will be more fully appreciated from the ensuing description of a preferred embodiment of the invention which is to be considered in connection with the accompanying Drawing.

DETAILED DESCRIPTION OF THE PREFERRED EMBODIMENT

Figure 1:
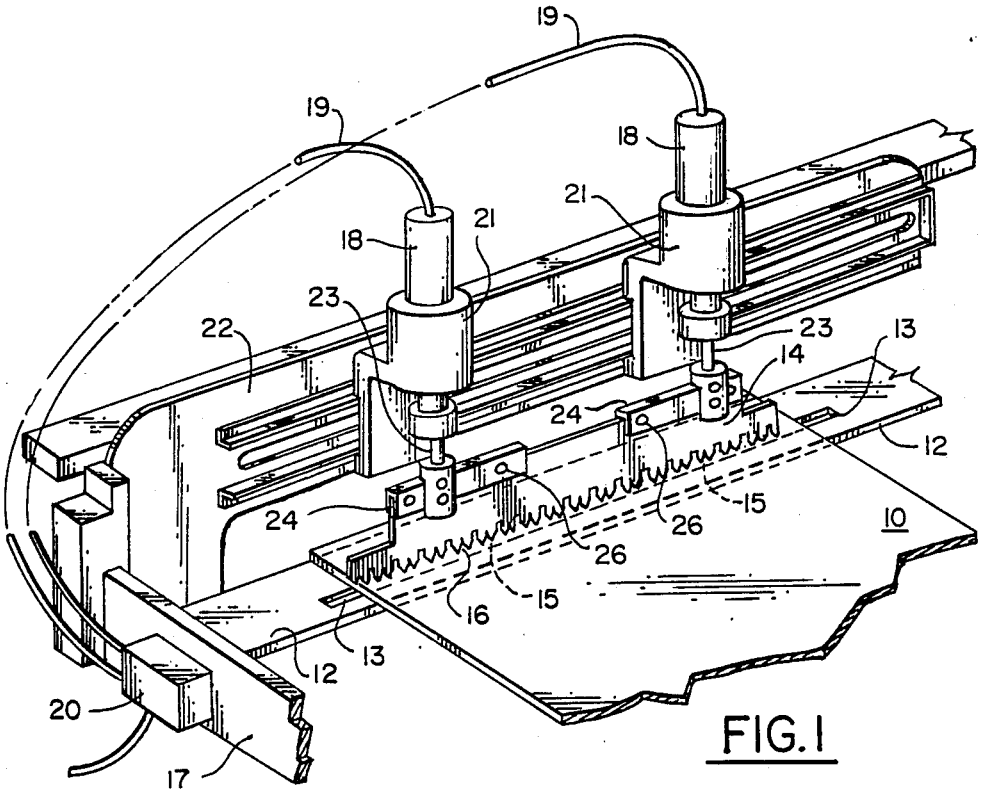
FIG. 1 is a front perspective view of apparatus according to one embodiment of the present invention.

Referring to the Drawing, FIG. 1 illustrates generally apparatus for perforating a line or series of slits across a double web or sheet of plastic film 10, which form, e.g., a series of polyethylene film bags for foodstuffs. The film is perforated to one side of a heat-sealed seam, and then is wound onto a drum or mandrel, in known fashion.

In operation, the film 10 is drawn over a plate or backing die 12, and the motion stops momentarily. The backing die 12 has an elongated aperture or passage through it of a size slightly larger than a cutting edge of a plate-like cutting head 14. The latter has a row of teeth 15 which pass through the film 10 and the aperture 13 of the backing die to form a series of slits or holes 16. The backing die 12 prevents the plastic film from being overstretched or torn when the series of slits 16 are punched through it The apparatus of FIG. 1 further has a frame 17 on which there are mounted a pair of reciprocating devices, here a pair of pneumatic cylinders 18 opposite the backing die 12. Other types of devices can be employed with the perforating head of this invention. There are pneumatic conduits 19 connected from a controller distributor 20 to the cylinders 18 for operating the same in synchronism with the feeding of the plastic film 10 over the backing die. A pair of guides 21 are positioned on a cantilevered support arm 22 to permit the cylinders 18 to be positioned as appropriate for the perforations to be formed. The backing die 12 can have more than one aperture or passage 13 to accommodate various sizes of cutting heads.

Figure 2:
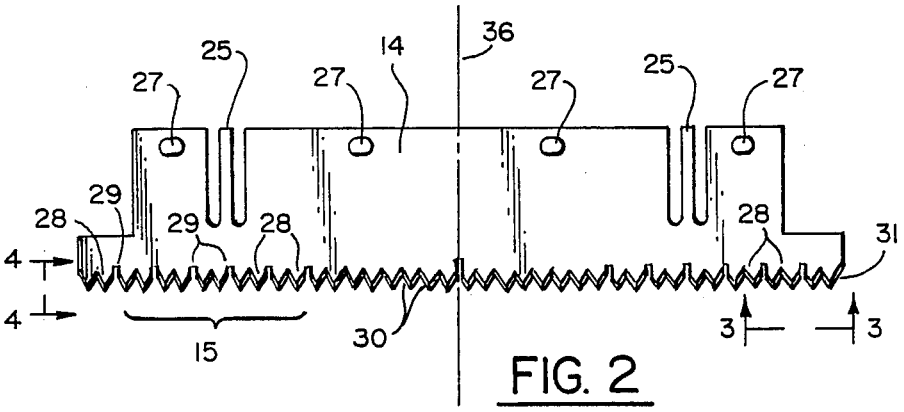
FIG. 2 is a front elevation of a perforating head of the preferred embodiment.
Figure 3:
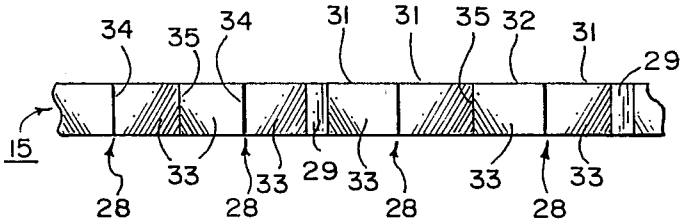
FIG. 3 is a partial edge view along lines 3—3 of FIG. 2.
Figure 4:
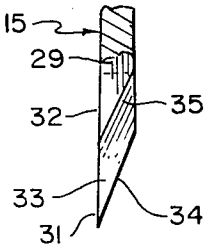
FIG. 4 is a partial side elevation along line 4—4 of FIG. 2.

Referring now also to FIGS. 2–4, the head 14 is attached to rods 23 of the cylinders 18 by means of attachments 24 which pass over locating tongues 25 of the head and secure the head by means of apertures 26 which align with apertures 27 in an upper edge of the head and are held by bolts, clips, or the like. The cutting teeth 15 are arranged in pairs 28 along a lower edge of the head 14.

The perforating head 14 is generally a plate of a suitable plastic synthetic resin which is soft enough to permit deflection when it strikes the backing die 12, yet stiff enough to punch slits or perforations continuously. An acetal homopolymer, namely Delrin, has been found to have properties which make it nearly ideal for this purpose. This material is resilient enough so that if the cutting head 14 contacts the backing die 12 during a punching stroke the teeth 15 have sufficient flexibility to permit the cutting operation to continue, rather than breaking the cutting teeth 15. Tetrafluoroethylene (Teflon) material has been found to be somewhat too soft for this use. Ceramics and metal have been found to be too rigid or too brittle.

The cutting teeth are provided with gaps 29 at intervals among the teeth 15. The gaps define spaces between slits in the perforations 16. The size and frequency of these gaps 29 are selected for an appropriate percentage of material remaining along the perforation line, depending on the type and thickness of the film 10 and the end use desired by the customer. The percent of material remaining can range from about 5 to 20 percent.

As illustrated in FIGS. 3 and 4, the pairs of teeth 28 are beveled and chisel-pointed, having slant faces 30 which form a knife edge 31 along a back surface 32 of the plate of the head 14. Beveled faces 33 of the teeth 15 define ridges 34 and valleys 35 that slant towards the back surface 32. With this construction, the acting of the plastic film 10 on the perforating head teeth 15 tends to wear the beveled faces 33 such that a new, sharp edge 31 is continuously presented as the head is used. This is not possible with previous metal or hard plastic cutting heads.

Figure 5:
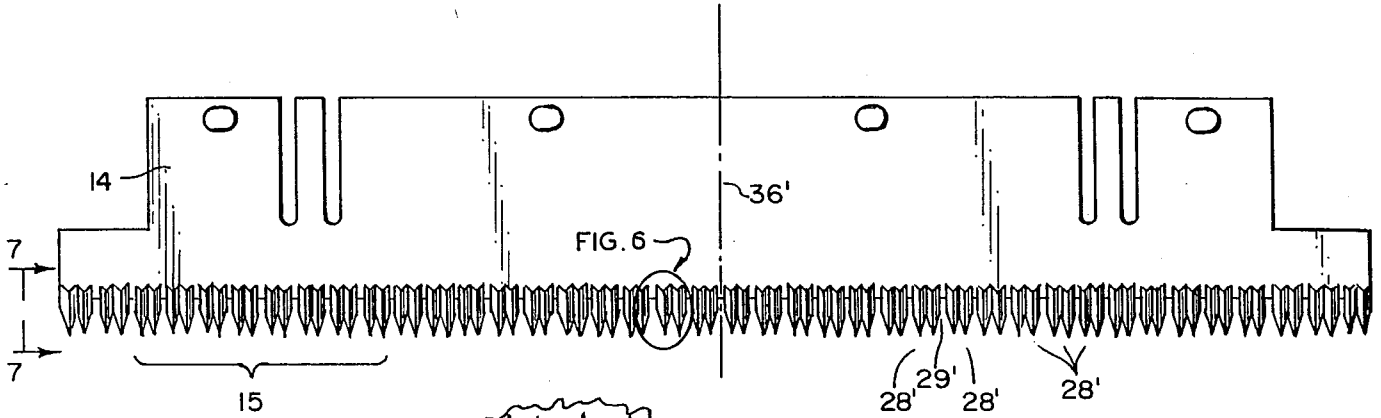
FIG. 5 is a front elevation of another perforating head according to embodiment of this invention.
Figure 6:
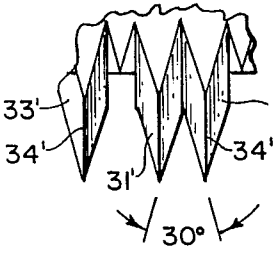
FIG. 6 illustrates an enlarged portion of FIG. 5.
Figure 7:
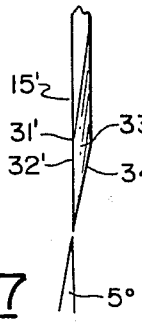
FIG. 7 is a partial side elevation along line 7—7 of FIG. 5.

An additional embodiment of a cutting head is illustrated in FIGS. 5, 6, and 7. Here parts and elements in common with the first embodiment are identified with like reference numbers, but primed. In this embodiment the teeth 15' are likewise formed in pairs 28' with gaps 29' between successive pairs of teeth. The bevel is selected to be rather steep so that the chisel points of the teeth 15' form an apex angle of about thirty degrees along the knife edge 31' (FIG. 6), and the ridges 34' angle at about five degrees to the back surface 32'. The gaps 29' can be constructed of sufficient height to accommodate the plastic film material.

These heads 14 and 14' can be formed in to parts, which abut one another at a mid line 36 or 36' as indicated as a dashed line in FIGS. 2 and 5.

In prior art devices which utilize cutters formed of metal, when the cutting head contacted the side walls of the backing plate itself, the cutting teeth would break. This breakage required the machine to be shut down and disassembled, and the entire cutting head had to be replaced or reground depending upon the severity of the break. With the interchangeable cutting head 14 or 14' of Delrin material, not only is the breakage problem eliminated, but the size of the perforation line 16 punched in the plastic film material can be readily varied. The machine operator has only to remove the plastic cutting head 14 from the attachments 24 and insert a new head 14. This ease of replacement permits inexpensive and rapid replacement of the operating cutting head 14 without necessitating substantial periods of down time.

Another benefit that has been attained by the use of these Delrin heads 14 is that the cutting head lasts far longer than a conventional metal cutting head. For example, it has been found that the tapered knife edge portions 31 which are formed on the chisel-pointed cutting teeth 15 actually form a self-sharpening cutting edge while punching slits in the plastic material. These replaceable cutting heads 14 have been found to last four times as long as metal cutting heads, and accordingly, are much less expensive both in initial cost and in replacement cost. This self-sharpening occurs because of plastic-on-plastic abrasion.

In addition, the lighter weight of the plastic cutting head 14 results in less wear on the mechanical components of the punching apparatus, which also helps reduce loosening of the cutting head 14 from the attachments 24.

The plastic material can be pigmented or colored s that cutting heads can be given different characteristic colors, for example, according to the size of teeth or type of plastic film with which used. This helps operators identify the head, even when the apparatus is operating at high speed.

While the invention has been described in the specification and illustrated in the drawings with reference to preferred embodiments, it will be understood by those skilled in the art that various changes may be made and equivalents may be substituted for elements thereof without departing from the scope of the invention. In addition, many modifications may be made to adapt a particular situation or material to the teachings of the invention without departing from the scope of the invention as defined in the appended claims.

What is claimed is:

1. In apparatus for perforating a web of plastic film material in which a reciprocal punching head is moved in a direction generally perpendicular to the plane of the film material and passes through the material and through an apertured backing die upon which the plastic film is supported thereby punching a series of slits across the web of film material; the improvement wherein said head is an interchangeable plastic cutting head carried on said apparatus and formed of a plate of a flexible semirigid plastic resin with a plurality of aligned and tapered cutting teeth forming a cutting edge, with spaces distributed at predetermined locations among said teeth, said teeth being beveled to form the cutting edge at a back surface so that said cutting edge is self-sharpening when employed to cut perforations in the plastic film material, said plastic resin being of sufficient resilience that if the head contacts the backing die during a perforating operation, the cutting teeth will resiliently deflect rather than break off, so that the cutting operation can continue.

2. The apparatus of claim 1 wherein said plastic resin is an acetal homopolymer.

3. The apparatus of claim 1 wherein said teeth are arranged in pairs with said gaps between successive pairs.

4. The apparatus of claim 1 wherein said head is formed as a pair of planar cutting head halves which abut one another at a mid line of the head.

5. Apparatus for perforating web of plastic film material in which a reciprocal punching head is moved in a direction that is generally perpendicular to the plane of the film material and passes through the material and through an apertured backing die upon which the plastic film is supported, thereby punching a series of slits across the web of film material; and comprising the improvement wherein said head is an interchangeable cutting head formed essentially entirely of a flexible semi-rigid plastic resin, and carried on said apparatus and formed of a plate of said resin with a plurality of aligned and tapered cutting teeth forming a cutting edge, with spaces distributed at predetermined locations among said teeth, said teeth being beveled to form the cutting edge at a back surface so that said cutting edge is self-sharpening when employed to cut perforations in the plastic film material, said plastic resin being of sufficient resilience that if the head contacts the backing die during a perforating operation, the cutting teeth will resiliently deflect rather than break off, so that the cutting operation can continue.

6. The apparatus of claim 5 wherein said plastic resin is an acetal homopolymer.

7. The apparatus of claim 6 wherein said plastic resin is pigmented to give the cutting head a predetermined characteristic color.

* * * * *

UNITED STATES PATENT AND TRADEMARK OFFICE

CERTIFICATE OF CORRECTION

PATENT NO. : 4,852,442

DATED : August 1, 1989

INVENTOR(S) : Earl T. Pottorff

It is certified that error appears in the above-identified patent and that said Letters Patent is hereby corrected as shown below:

Col. 5, line 11, please delete the word "said", line 16, after the word perforating, please add --a--.

Signed and Sealed this

Twenty-fourth Day of July, 1990

*Attest:*

HARRY F. MANBECK, JR.

*Attesting Officer*

*Commissioner of Patents and Trademarks*